US011059305B2

(12) United States Patent
Obara

(10) Patent No.: US 11,059,305 B2
(45) **Date of Patent: *Jul. 13, 2021**

(54) PRINTER

(71) Applicant: SATO HOLDINGS KABUSHIKI KAISHA, Tokyo (JP)

(72) Inventor: Takeshi Obara, Tokyo (JP)

(73) Assignee: SATO HOLDINGS KABUSHIKI KAISHA

( * ) Notice: Subject to any disclaimer, the term of this patent is extended or adjusted under 35 U.S.C. 154(b) by 0 days.

This patent is subject to a terminal disclaimer.

(21) Appl. No.: 16/354,903

(22) Filed: Mar. 15, 2019

(65) Prior Publication Data

US 2019/0210382 A1 Jul. 11, 2019

Related U.S. Application Data

(60) Continuation of application No. 15/783,104, filed on Oct. 13, 2017, now Pat. No. 10,272,701, which is a (Continued)

(30) Foreign Application Priority Data

Mar. 26, 2013 (JP) ..... 2013-063676

(51) Int. Cl.
*B41J 11/04* (2006.01)
*B41J 2/32* (2006.01)
(Continued)

(52) U.S. Cl.
CPC ..... *B41J 11/04* (2013.01); *B41J 2/32* (2013.01); *B41J 11/0095* (2013.01);
(Continued)

(58) Field of Classification Search
CPC ..... B41J 11/04; B41J 2202/31; B41J 29/13; B41J 2/32; B41J 11/00; B41J 3/36;
(Continued)

(56) References Cited

U.S. PATENT DOCUMENTS 6,004,053 A 12/1999 Petteruti ..... 400/693
6,061,076 A 5/2000 Ishii ..... 347/197
(Continued)

FOREIGN PATENT DOCUMENTS

JP S 60-142943 U 9/1985
JP H02-064056 U 5/1990
(Continued)

OTHER PUBLICATIONS

International Search Report dated Mar. 4, 2014 issued in corresponding International patent application No. PCT/JP2013/084826.
(Continued)

*Primary Examiner* — Kristal Feggins
(74) *Attorney, Agent, or Firm* — Ostrolenk Faber LLP

(57) ABSTRACT

A printer according to an embodiment includes: a printer body including a supplying part that rotatably holds a roll-shaped sheet member; an opening and closing cover configured to open and close with respect to the printer body; a thermal head disposed on the printer body, the thermal head configured to print on the sheet member; a platen roller disposed on the opening and closing cover, the platen roller positioned at a location opposite to the thermal head and feeding the sheet member in a closed configuration; and a platen roller holding mechanism configured to attachably and detachably secure the platen roller to the opening and closing cover. The platen roller holding mechanism includes a label roll supporter that rotatably guides the roll-shaped sheet member in the supplying part. The label roll supporter includes a cross-sectional arc-shaped surface.

32 Claims, 5 Drawing Sheets

Related U.S. Application Data division of application No. 14/779,734, filed as application No. PCT/JP2013/084826 on Dec. 26, 2013, now Pat. No. 9,821,572.

(51) Int. Cl.

| | |
|---|---|
| ***B41J 29/13*** | (2006.01) |
| ***B41J 11/00*** | (2006.01) |
| ***B41J 15/04*** | (2006.01) |
| ***B41J 29/02*** | (2006.01) |

(52) U.S. Cl.

CPC ..... *B41J 15/042* (2013.01); *B41J 29/023* (2013.01); *B41J 29/13* (2013.01); *B41J 2202/31* (2013.01)

(58) Field of Classification Search

CPC ..... B41J 11/02; B41J 11/053; B41J 11/057; B41J 11/06; B41J 11/08; B41J 11/10; B41J 11/13

See application file for complete search history.

(56) References Cited

U.S. PATENT DOCUMENTS

| | | | | |
|---|---|---|---|---|
| 6,118,469 | A | 9/2000 | Hosomi | 347/222 |
| 9,821,572 | B2 | 11/2017 | Obara | |
| 2006/0039737 | A1 | 2/2006 | Takami | 400/613 |
| 2015/0042742 | A1 | 2/2015 | Onodera | 347/220 |
| 2019/0248155 | A1* | 8/2019 | Watanabe | B41J 2/32 |

FOREIGN PATENT DOCUMENTS

| | | | |
|---|---|---|---|
| JP | H 03-199069 | A | 8/1991 |
| JP | H04-030952 | U | 3/1992 |
| JP | H 05-35385 | | 5/1993 |
| JP | H 07-132653 | A | 5/1995 |
| JP | 2001-302073 | | 10/2001 |
| JP | 2002-166610 | A | 6/2002 |
| JP | 2003-300351 | A | 10/2003 |
| JP | 2005-81730 | | 3/2005 |
| JP | 2010-167680 | A | 8/2010 |
| JP | 2011-51308 | | 3/2011 |
| JP | 2019-031108 | A | 2/2019 |

OTHER PUBLICATIONS

Japanese Office Action dated Jan. 30, 2018, issued in corresponding Japanese Patent Application No. 2017-025827. Including English translation. Total 5 pages.

Office Action dated Aug. 14, 2018 in corresponding Japanese Patent Application No. 2017-025827.

Office Action dated Oct. 1, 2019 issued in corresponding Japanese Patent Application No. 2018-227169 (without English translation).

Japanese Office Action dated Feb. 2, 2021, Issued in corresponding Japanese Patent Application No. 2020-013136. English translation. Total 6 pages.

* cited by examiner

PRINTER

CROSS REFERENCE TO RELATED APPLICATIONS

The present application is a continuation of U.S. patent application Ser. No. 15/783,104, filed Oct. 13, 2017, which is a divisional of U.S. application Ser. No. 14/779,734, filed Sep. 24, 2015, now U.S. Pat. No. 9,821,572, issued Nov. 21, 2017, which is a 35 U.S.C. § 371 National Phase conversion of PCT/JP2013/084826, filed Dec. 26, 2013, which claims benefit of Japanese Patent Application No. 2013-063676, filed Mar. 26, 2013, the disclosures of which are incorporated herein by reference. The PCT International Application was published in the Japanese language.

TECHNICAL FIELD

A present disclosure relates to a printer. In particular, the present disclosure relates to a miniaturized printer with a simplified structure.

BACKGROUND ART

Conventionally, a thermal-type printer is known that prints via thermal transfer onto a printing medium, by pressing and clamping a printing medium with a thermal head and a platen roller, and selectively heating a heating element that is above the thermal head.

The platen roller of the printer requires periodic exchange because problems occur such as roller wear from feeding of the printing medium, deterioration of a roller element resulting from an environmental factor or passage of time, or the like. In addition, a user or serviceman desires a method of performing an easier and faster exchange each time.

Moreover, in a case where the printer is a portable printer, greater miniaturization is desirable for greater portability when compared to a conventional printer.

JP-A 2001-302073 describes unitization of a platen and a fixed blade, such that part detachment and part attachment may be performed via a single process, and a maintenance process may be easily performed.

RELATED ART

Patent Literature

Patent Literature 1: JP-A 2001-302073

SUMMARY OF THE INVENTION

A present disclosure has been conceived of in view of various conventional problems. Accordingly, a printer is proposed that allows an exchange and attachment of a platen roller via a simple configuration and method, and allows for printer miniaturization.

A printer according to an embodiment includes:

a printer body including a supplying part that rotatably holds a roll-shaped sheet member;

an opening and closing cover configured to open and close with respect to the printer body;

a thermal head disposed on the printer body, the thermal head configured to print on the sheet member;

a platen roller disposed on the opening and closing cover, the platen roller positioned at a location opposite to the thermal head and feeding the sheet member in a closed configuration; and a platen roller holding mechanism configured to attachably and detachably secure the platen roller to the opening and closing cover, the platen roller holding mechanism including a label roll supporter that rotatably guides the roll-shaped sheet member in the supplying part, the label roll supporter including a cross-sectional arc-shaped surface.

The printer may further include a detector detecting the sheet member, the detector attached to the platen roller holding mechanism.

The label roll supporter may further includes a first roll supporter. The first roll supporter may be formed from a plurality of ribs.

The platen roller holding mechanism may include a guide that guides the sheet member in a vicinity of an upstream side of the platen roller.

The opening and closing cover may include an insertion opening configured to detachably inserts a shaft of the platen roller thereinto, and the platen roller holding mechanism includes a platen roller holder configured to close the insertion opening.

The opening and closing cover may include a holding hole that rotatably supports the platen roller, the holding hole being a long hole, and the platen roller may be configured to freely move inside the long hole.

A second roll supporter may be formed on an inner surface of the opening and closing cover, and the first roll supporter of the platen roller holding mechanism and the second roll supporter may be aligned to form a single arc.

According to a printer of a present disclosure, printer miniaturization and platen roller exchange are made possible via a simple configuration and method.

DETAILED DESCRIPTION OF THE INVENTION

Figure 1:
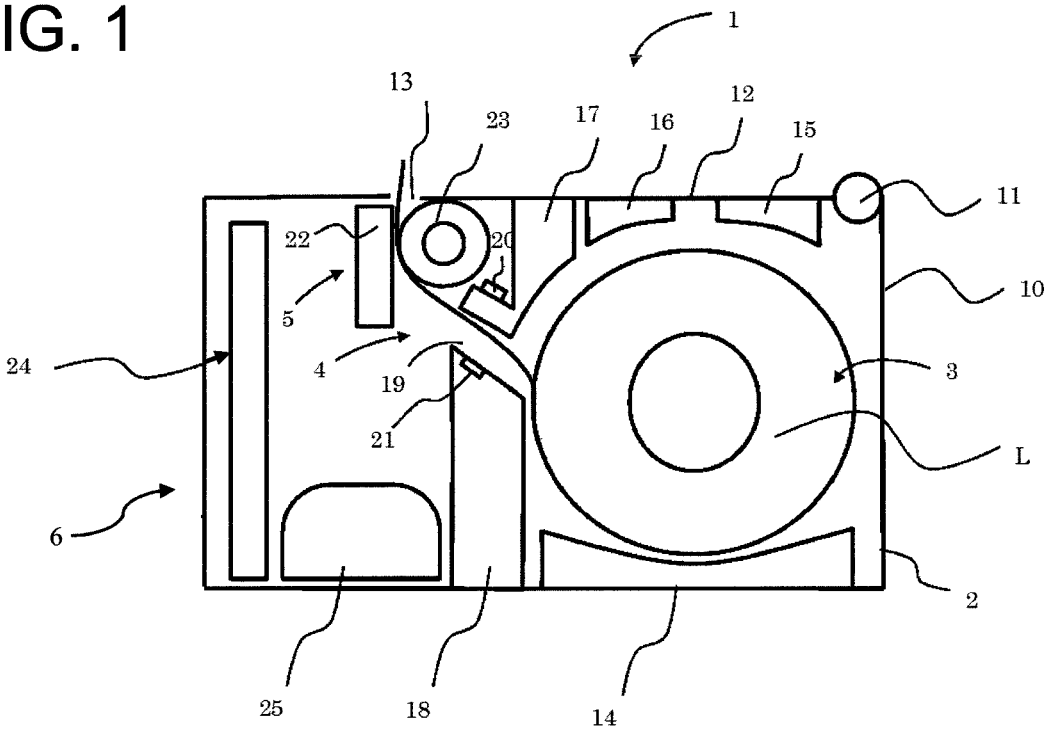
FIG. 1 shows a schematic side surface view of a thermal printer 1 that relates to an Embodiment 1 of a present disclosure.
Figure 2:
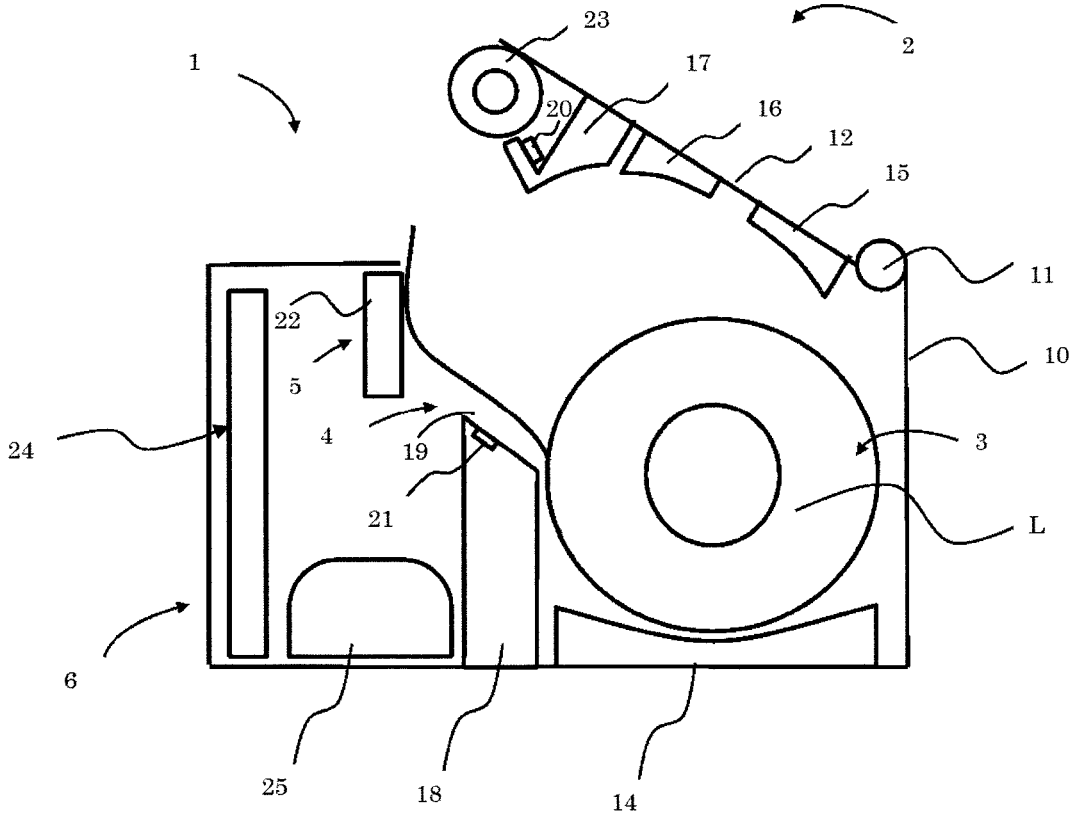
FIG. 2, similarly, shows a schematic side surface view of an opening and closing cover 12 in an opened configuration with respect to a printer housing 10.

Embodiment 1 is based on FIGS. 1 to 6, which will be described hereinafter. FIG. 1 shows a schematic side surface view of a thermal printer 1 according to Embodiment 1 of a present disclosure, and an opening and closing cover 12 in an opened configuration with respect to a printer housing 10. FIG. 2 shows the opening and closing cover 12 in an opened configuration with respect to the printer housing 10. The thermal printer 1 is a portable printer having an internal battery. The thermal printer 1 includes: a printer body 2; a supplying part 3; a detector 4; a printer 5; and a controller 6.

The printing medium used in Embodiment 1 is a continuous label body L that has a plurality of labels temporarily attached at predetermined intervals on a strip-shaped mount. The printing medium is used by being rolled into rolled-shape.

The printer body 2 includes: a printer housing 10; a printer opening and closing shaft 11; an opening and closing cover 12; and a label ejection port 13. The printer housing 10 includes a bottom plate and a side plate. The printer housing 10 is such that the printer opening and closing shaft 11 is attached to a first end of the side plate. The opening and closing cover 12 may be rotated to attach to the printer opening and closing shaft 11. A closed configuration of the printer housing 10 is shown in FIG. 1 and an opened configuration of the printer housing 10 is shown in FIG. 2. A space is formed between a second end of the opening and closing cover 12 and the printer housing 10 as the label ejection port 13. The continuous label body L, which the printer 5 has applied print to, is fed from a feeding direction upstream side where supplying part 3 is disposed towards a feeding direction downstream side where the label ejection port 13 is disposed. The continuous label body L is ejected to an exterior of the printer body 2.

The label supplying part 3, which includes a first roll supporter 14, a second roll supporter 15, and a third roll supporter 16, may rotatably hold the continuous label body L. The first roll supporter 14 is a thin plate that has one side surface cut into an arc shape. A plurality of first roll supporters 14 are disposed at predetermined intervals. The plurality of first roll supporters 14 have an arc-shaped surface that faces the side of the roll-shaped continuous label body L. The plurality of first roll supporters 14 are disposed in the printer housing 10 in parallel with a winding direction of the continuous label body L. Moreover, a second roll supporter 15 and a third roll supporter 16 are thin plates that each have one side surface cut to form a single arc-shaped fourth roll supporter 39 of a platen roller holding mechanism 17 mentioned hereinafter. The second roll supporter 15 and the third roll supporter 16 are disposed on an inner surface of the opening and closing cover 12. The plurality of second roll supporters 15 are disposed at predetermined intervals in a label width direction, on a first side of the opening and closing cover 12 (feeding direction upstream side). The plurality of second roll supporters 15 have an arc-shaped surface that faces the side of the continuous label body L in a case where the opening and closing cover 12 is in an opened configuration. The plurality of second roll supporters 15 are attached in parallel with a winding direction of the continuous label body L. The plurality of third roll supporters 16 and the plurality of second roll supporters 15 are each aligned into a plurality of rows, such that the third roll supporter 16 and the second roll supporter 15 in each row oppose each other. The second roll supporter 15, the third roll supporter 16, and the fourth roll supporter 39 of a platen roller holding mechanism 17 are attached to another side of the opening and closing cover 12 to form a single arc (feeding direction downstream side). The continuous label body L may be smoothly fed without rotation by using the roll supporters to reduce a contact surface area of a roll-shaped continuous label body L inside the supplying part 3.

The label detector 4 includes a light emitter 20 and a light receiver 21 as the detector. The light receiver 21 is attached to a first label guide 18 disposed on the printer housing 10. The first label guide 18 is part of a feeding pathway that guides a surface side (printing surface side) of the continuous label body L and prevents flapping of the continuous label body L. Moreover, the light emitter 20 attached to the platen roller holding mechanism 17 is disposed on a second end side of the opening and closing cover 12. The platen roller holding mechanism 17 is a member that may be composed of a material such as a resin. The platen roller holding mechanism 17 is disposed between the third roll supporter 16 and a platen roller 23 (vicinity of an upstream side of the printer 5). The first label guide 18 is also a member composed of a material such as a resin. The first label guide 18 is attached to the printer housing 10. The first label guide 18 is disposed between the first roll supporter 14 and a battery 25. In a case where the opening and closing cover 12 is in a closed configuration, the platen roller holding mechanism 17 and the first label guide 18 are disposed so as to face each other, and a part of the platen roller holding mechanism 17 that faces the first label guide 18 forms a second label guide 37 that guides a rear surface side (mount side) of continuous label body L. The surfaces of the platen roller holding mechanism 17 and the first label guide 18 that oppose each other form mutually inclined parallel surfaces that face the printer 5, and a label feeding pathway 19 of the continuous label body L is formed by the first label guide 18 and the second label guide 37. The light emitter 20 is attached to the platen roller holding mechanism 17 so as to emit light from a rear surface side of the continuous label body L above the label feeding pathway 19. The light receiver 21 is attached to the first label guide 18 on a surface side of the continuous label body L above the label feeding pathway 19, such that a light transmission emitted from the light emitter 20 facing the continuous label body L is received. As a transmission-type sensor, a reflection-type sensor receives a reflected amount of emitted light may be disposed in the platen roller holding mechanism 17. Moreover, a first light emitter or a light receiver of a transmission-type sensor or a reflection-type sensor may be included in the platen roller holding mechanism 17, while a second light emitter or light receiver of a transmission-type sensor may be included the first label guide 18.

The label printer 5 includes a thermal head 22 and the platen roller 23. The thermal head 22 is disposed on the printer housing 10 in a vicinity of the label ejection port 13. The platen roller 23 is rotatably attached to the platen roller holding mechanism 17 of the opening and closing cover 12. The heating element of the surface side of the thermal head 22 and the platen roller 23 are both disposed so as to face each other in a case where the opening and closing cover 12 is in a closed configuration. In addition, a drive motor (not shown) is included in the printer housing 10. The drive motor may be rotatably driven by engaging the gears of the platen roller 23 while the opening and closing cover 12 is in a closed configuration. The thermal head 22 includes a head bracket (not shown). The head bracket is configured to rotatably support a bearing 35 of the platen roller 34 by a platen engagement part disposed on both side surfaces of the head bracket in a case where the opening and closing cover 12 is in a closed configuration. An elastic member (not shown) is disposed on the head bracket. The thermal head 22 is pressed on a side of the platen roller 23 via a predetermined pressing force in a case where the continuous label body L is sandwiched by the platen roller 23 and the thermal head 22. Next, printing is applied to the continuous label body L, and the continuous label body L is fed to the label ejection port 13. The elastic member maintains a closed configuration by biasing the bearing 35 of the platen roller 34 in support direction via the platen engagement part. The opening and closing cover 12 may be disengaged by rotating the head bracket against the biasing force of the elastic member and disengaging the bearing 35 from the platen engagement part.

The printer 6 includes a control board 24 and the battery 25. The control board 24 includes: a CPU; a ROM: and a RAM, or the like. The control board 24 controls an operation of each part. The battery 25 supplies power for the operation of each part.

The thermal printer 1 of the present embodiment 1 includes the abovementioned configuration. The continuous label body L is fed to a label supplying part 3. The fed continuous label body L is fed to the label printer 5 via the label detector 4. The continuous label body L in the label printer 5 is sandwiched between the thermal head 22 and the platen roller 23, and printing is applied at a predetermined location. After the printing has been applied, the continuous label body L is ejected from the label ejection port 13 to the exterior.

Figure 3:
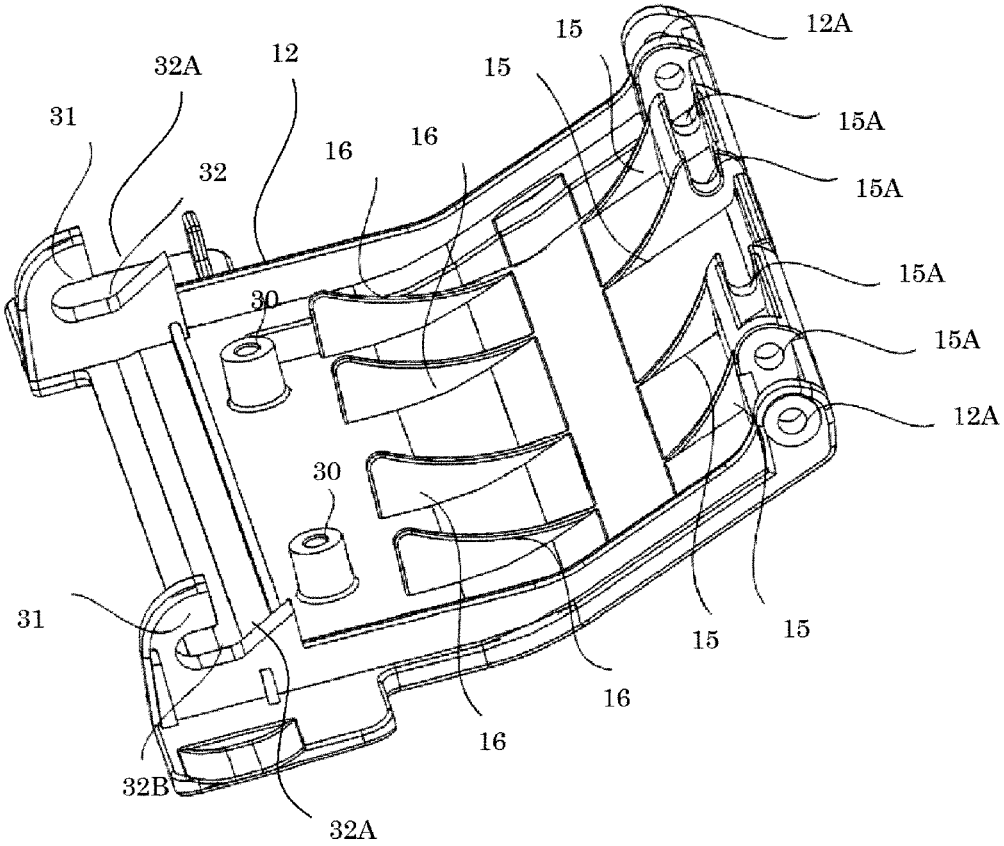
FIG. 3, similarly, shows a perspective view of a rear side of the opening and closing cover 12.
Figure 7:
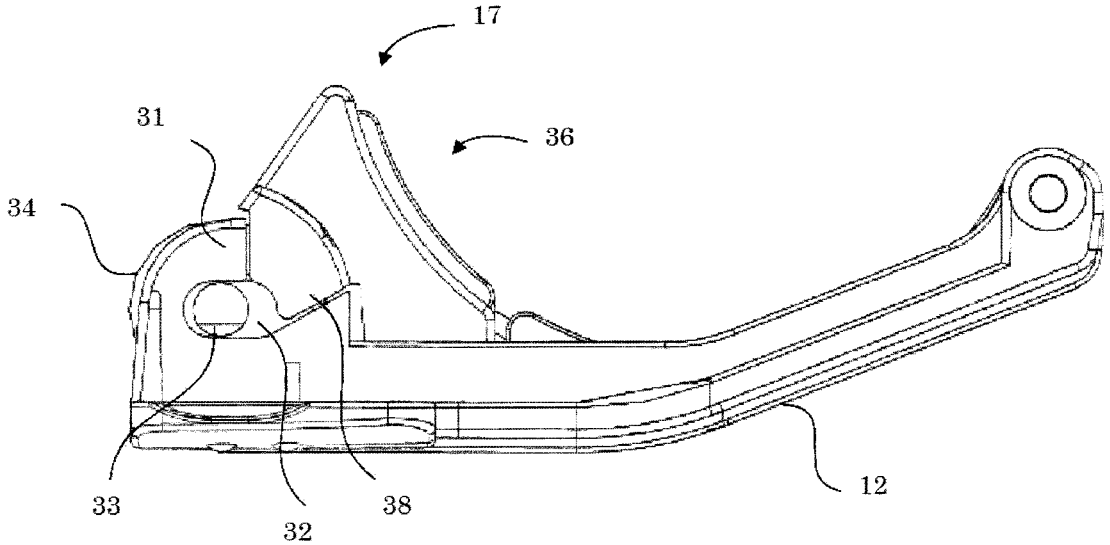
FIG. 7, similarly, shows a side surface view of the cover opening and closing shaft 11, the platen roller 23, and the platen roller holding mechanism 17 attached to the opening and closing cover 12.

Next, a periphery of the opening and closing cover 12 will be described in greater detail. FIG. 3 shows a perspective view of a rear side of the opening and closing cover 12. The above described second roll supporter 15, the third roll supporter 16, a screw hole 30, a platen roll holding protrusion piece 31, and a space 32 are disposed in an inner side surface of the opening and closing cover 12. A cover opening and closing shaft through hole 12A and a cover opening and closing shaft through hole 15A are disposed on a first end of the opening and closing cover 12. A cover opening and closing shaft 11 is a metallic cylindrical shaft. The cover opening and closing shaft 11 is inserted into the cover opening and closing shaft through hole 12A and the cover opening and closing shaft through hole 15A. A first and second threaded hole 30 are disposed on a downstream side of a plurality of third roll supporters 16. A screw (not shown) is threaded into the first and second threaded hole 30 so as to attach and fix the platen roller holding mechanism 17 to the opening and closing cover 12. The second roll supporter 15, the third roll supporter 16, the first roll supporter 14 of the printer housing 10, and the hereinafter-mentioned fourth roll supporter 39 of the platen roller holding mechanism 17 function as roll guides that guide a peripheral surface of the roll-shaped continuous label body L loaded onto the label supplying part 3. The platen roller holding protrusion piece 31 is disposed on both side surfaces of an end opposite to a side that includes the cover opening and closing shaft 11 and the cover opening and closing shaft through hole 12A. The space 32 is formed between the platen roller holding protrusion piece 31 and the opening and closing cover 12. The space 32 includes a platen roller insertion opening 32A and a platen roller holding hole 32B. The platen roller insertion opening 32A allows a platen roller holder 38 of the hereinafter described platen roller holding mechanism 17 to fit into the space 32; and the platen roller holding hole 32B allows a shaft of the platen roller 23 to pass into the space 32. The platen roller holding hole 32B is formed as a long hole. The platen roller holder 38 is inserted into the platen roller insertion opening 32A as shown in FIG. 7. The long hole is longer than the diameter of the platen roller shaft 33. The platen roller shaft 33 is freely rotatably within the long hole and freely movable in a feeding direction of the continuous label body L. In a case where the opening and closing cover 12 is in a closed configuration, relative positioning of the thermal head 22 and the platen roller 23 may be achieved by the platen engagement part of the head bracket. In other words, optimum positioning of the thermal head 22 and the platen roller 23 may be achieved without the influence of an assembly error, in order to enable an adjustment of a position of the platen roller 34 within the long hole even in a case of a device assembly error.

Figure 4:
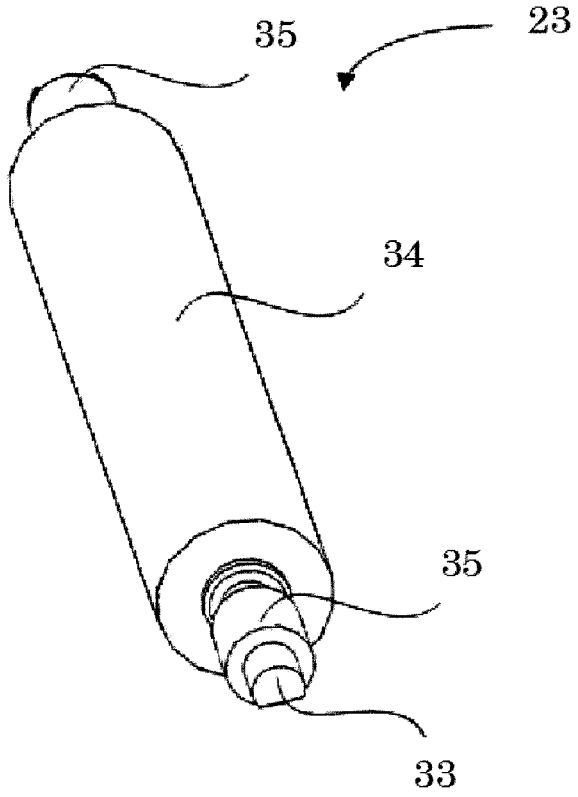
FIG. 4, similarly, shows a perspective view of a platen roller 23.

FIG. 4 shows a perspective view of the platen roller 23. The platen roller 23 includes: a platen roller shaft 33; a platen roller body 34; and a bearing 35. The platen roller shaft 33 is composed of a metal such as stainless steel. The platen roller shaft 33 has a first end of a cylindrical metal rod cut into a cross-sectional D shape. A gear (not shown) of the platen roller 34 is fixed to the first end. The platen roller body 34 is an elastic body, e.g., a polyurethane rubber or a silicone rubber. The platen roller body 34 has a hole at a central axis thereof. The platen roller shaft 33 is inserted and fixed to the hole. In a case where the platen roller shaft 33 is rotatably driven, the platen roller body 34 is also rotatably driven. A first and second bearing 35 are fixed at intervals to both sides of the platen roller shaft 33, and fixed at intervals to an exterior of the platen roller body 34.

Figure 5:
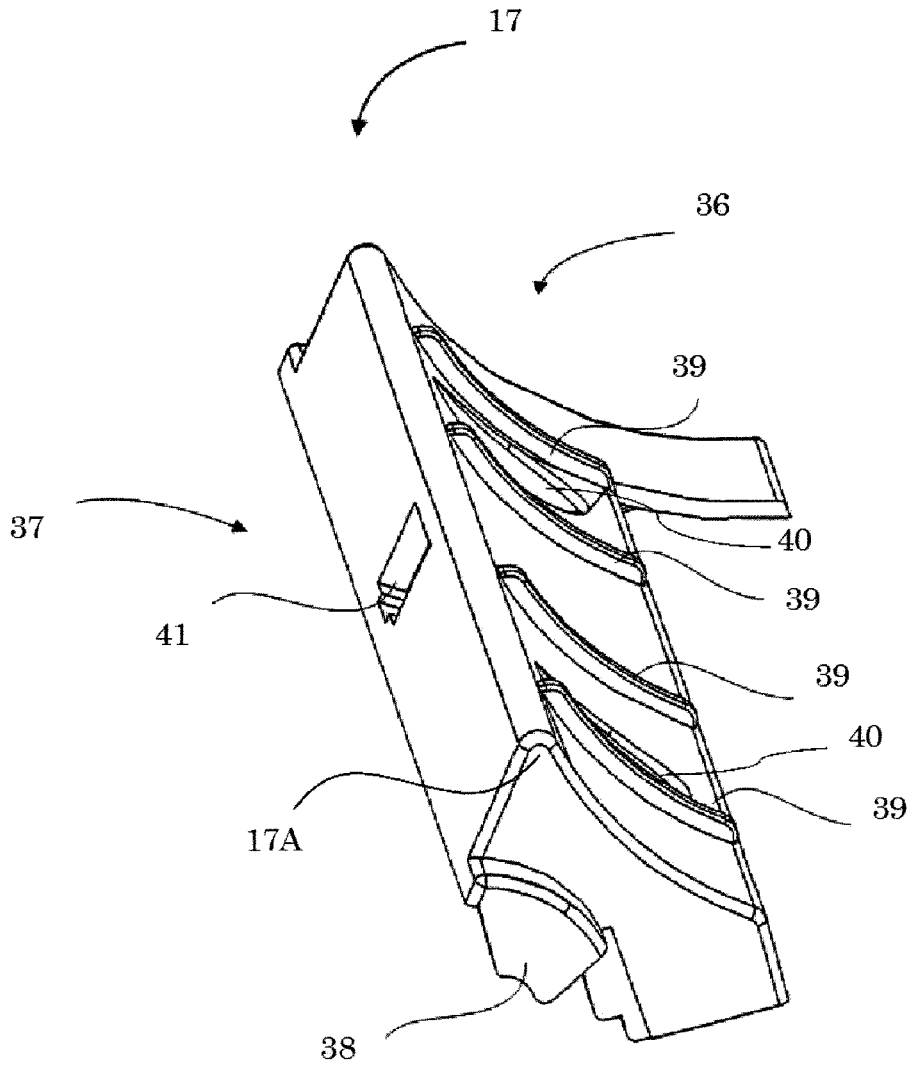
FIG. 5, similarly, shows a perspective view a platen roller holding mechanism 17.

FIG. 5 shows a perspective view of the platen roller holding mechanism 17. The platen roller holding mechanism 17 is a member that has a width approximately equal to a width direction of the printer housing 10. The platen roller holding mechanism 17 includes: a label roll supporter 36; the second label guide 37; and the platen roller holder 38.

The label roll supporter 36 is a cross-sectional arc-shaped surface disposed on one surface of the platen roller holding mechanism 17. The label roll supporter 36 includes the fourth roller supporter 39. The plurality of fourth roll supporters 39 are plate-shaped members that are vertically erected on a surface of the label supporter 36. A vicinity of an upper portion thereof is arc-shaped so as to rotatably support a roll-shaped continuous label body L inside the supplying part 3. Moreover, two screw through holes 40 are disposed on the platen roller holding mechanism 17. The platen roller holding mechanism 17 is attached to the opening and closing cover 12 by a screw (not shown).

The second label guide 37 is a surface disposed on the opposite surface of the label roll supporter 36. The second label guide 37 forms a part of the feeding pathway along with the first label guide 18. A detector window 41 is disposed on the second label guide. The second label guide 37 and the label roll supporter 36 are both integrally formed via a curved part 17A that is bent into an acute angle. The acute angle allows for the label supplying part to have a larger arc, the paper roll to be further stabilized, the continuous label body L to be guided, and the label feeding pathway to be narrowed by an interval between the first label guide 18 and the second label guide 37, such that the continuous label body L may be more accurately fed to the printer. In addition, the detector includes the light emitting device 20 positioned on the detector window 41. The light emitter 20 is part of the detector. Because the flapping of the continuous label body L may be prevented within a narrow feeding pathway, a single detection of a label may be performed in highly precise manner.

The first and second platen roller holder 38 is disposed between the label roll supporter 36 and the second label guide 37 and on a lower part of the second label guide 37, on both ends of the platen roller holding mechanism 17. The first and second platen roller holder 38 is integrally formed with the platen roller holding mechanism 17. The first and second platen roller holder 38 is a protruding piece that outwardly protrudes in a curved shape. The protruding piece is formed so as to engage with the platen roller insertion opening 32A of the printer body 2.

Figure 6:
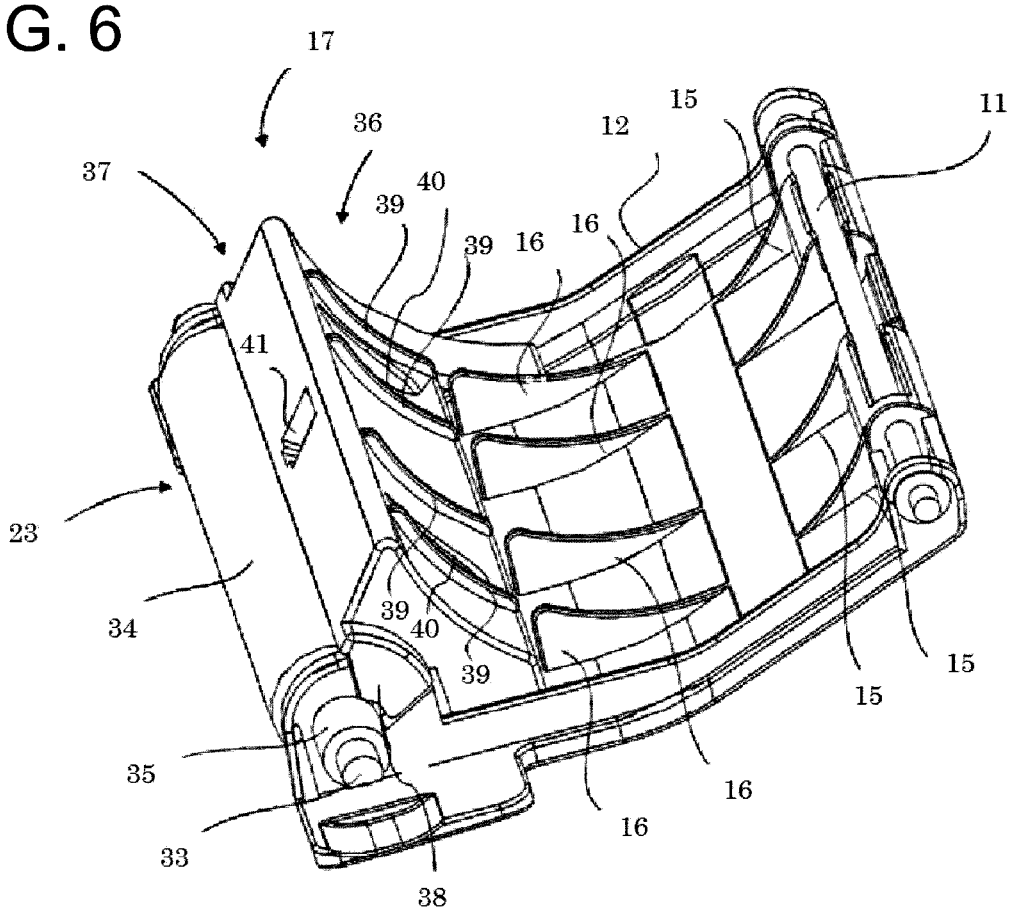
FIG. 6, similarly, shows a perspective view of a cover opening and closing shaft 11, the platen roller 23, and the platen roller holding mechanism 17 attached to the opening and closing cover 12.

FIG. 6 shows a perspective view of the cover opening and closing shaft 11, the platen roller 23, and the platen roller holding mechanism 17 attached to the opening and closing cover 12. The periphery of the opening and closing cover 12 has the above configuration. The cover opening and closing shaft 11 inserts into the cover opening and closing shaft through hole 12A, 15A, included at a first end. The opening and closing cover 12 freely rotates with respect to the printer housing 10. The opening and closing cover 12 is configured to open and close with respect to the printer housing 10. The platen roller shaft 33 that is between the bearing 35 and the platen roller body 34 of the platen roller 23 on an end at an opposite side passes through a platen roller holding hole 32B, and fits into a platen roller insertion opening 32A by having the platen roller holder 38 of the platen roller holding mechanism 17 engage with the platen roller insertion opening 32A, such that the platen roller 23 is rotatably supported inside the platen roller holding hole 32B. The label roll supporter 36 of the platen roller holding mechanism 17 rotatably supports a roll-shaped continuous label body L. The plurality of fourth roll supporters 39 each form a singular arc shaped row that includes a corresponding second roll supporter 15 and third roll supporter 16. Thus, by supporting a circumference of the continuous label body L with straight lines of the arc shape supporters, rather than supporting the circumference of the continuous label body L with a surface shape, friction may be reduced and the feeding of the continuous label body L may be smoothly performed.

Accordingly, based on the configuration of the present disclosure, the rolled paper supporter and the rolled paper detector are included in the platen roller holding mechanism, and integrally formed therewith. Therefore, rather than independently forming each part, fewer parts are used, assembly has been simplified, and printer miniaturization has been achieved.

DESCRIPTION OF REFERENCE NUMERALS

1 Thermal printer
2 Printer body
3 Label supplying part
4 Label detector
5 Label printer
6 Controller
10 Printer housing
11 Printer opening and closing shaft
12 Opening and closing cover
12A Cover opening and closing shaft through hole
13 Label ejection port
14 First roll supporter
15 Second roll supporter
15A Cover opening and closing shaft through hole
16 Third roll supporter
17 Platen roller holding mechanism
18 First label guide
19 Label feeding pathway
20 Light emitter
21 Light receiver
22 Thermal head
23 Platen roller
24 Control board
25 Battery
30 Screw hole
31 Platen roller holding protrusion piece
32 Space
32A Platen roller insertion opening
32B Platen roller holding hole
33 The platen roller shaft
34 Platen roller body
35 Bearing
36 Label roll supporter
37 Second label guide
38 Platen roller holder
39 Fourth roll supporter
40 Screw through hole
41 Detector window

What is claimed is:

1. A printer, comprising:
a printer body configured to hold a rolled-shape printing medium;
a cover configured to open and close with respect to the printer body;
a thermal head disposed on the printer body and configured to print on the printing medium;
a platen roller disposed on the cover and detachable therefrom, the platen roller positionable at a location opposite to the thermal head and configured to feed the printing medium when the cover is closed;
a pair of insertion openings in the cover configured to receive a shaft of the platen roller; and
a pair of platen roller holders connected to the cover and configured to close the insertion openings.

2. A printer as set forth in claim 1, wherein at least a portion of each insertion opening of the pair of insertion openings is arc-shaped.

3. A printer as set forth in claim 1, wherein at least a portion of each platen roller holder of the pair of platen roller holders is arc-shaped.

4. A printer as set forth in claim 1, wherein each platen roller holder of the pair of platen roller holders is configured to close an insertion opening such that the shaft is retained by the cover.

5. A printer as set forth in claim 1, further comprising protrusion pieces protruding at an end of the cover to form the insertion openings, wherein another end of the cover is rotatably attached to the printer body.

6. A printer as set forth in claim 1, further comprising:
a platen roller holding mechanism, wherein the platen roller holders are part of the platen roller holding mechanism.

7. A printer as set forth in claim 6, wherein the platen roller holding mechanism comprises an arc-shaped portion shaped to accommodate the rolled-shape printing medium.

8. A printer as set forth in claim 6, wherein the platen roller holding mechanism is configured to hold the platen roller to the cover and release the platen roller from the cover.

9. A printer as set forth in claim 6, wherein the platen roller holding mechanism is detachably attached to the cover, the platen roller holding mechanism configured to hold the platen roller to the cover when the platen roller holding mechanism is attached to the cover, and configured to release the platen roller from the cover when the platen roller holding mechanism is detached from the cover.

10. A printer as set forth in claim 6, wherein the printer body includes a first medium guide and the platen roller holding mechanism includes a second medium guide, the first medium guide and the second medium guide facing each other when the cover is closed.

11. A printer as set forth in claim 6, wherein the printer body includes a first medium guide and the platen roller holding mechanism includes a second medium guide, the first medium guide and the second medium guide forming parallel surfaces when the cover is closed.

12. A printer as set forth in claim 6, wherein the platen roller holding mechanism is attached to an inner surface of the cover.

13. A printer as set forth in claim 6, wherein the platen roller holding mechanism is attached to an inner surface of the cover by at least one screw.

14. A printer as set forth in claim 6, wherein the platen roller holding mechanism is detachable from the cover.

15. A printer as set forth in claim 1, further comprising protrusion pieces protruding from an inner surface of the cover to form the insertion openings.

16. A printer as set forth in claim 1, wherein the platen roller holders are detachable from the insertion openings.

17. A printer, comprising:

a printer body configured to hold a rolled-shape printing medium;

a cover configured to open and close with respect to the printer body;

a thermal head disposed on the printer body and configured to print on the printing medium;

a platen roller disposed on the cover and detachable therefrom, the platen roller positionable at a location opposite to the thermal head and configured to feed the printing medium when the cover is closed;

a pair of protrusion pieces on an inside of the cover respectively forming a pair of insertion openings configured to receive a shaft of the platen roller; and a pair of holders connected to the cover, the pair of holders are configured to respectively fit together with the pair of protrusion pieces to close the pair of insertion openings while holding the shaft of the platen roller.

18. A printer as set forth in claim 17, further comprising:

a platen roller holding mechanism, wherein the pair of holders are parts of the platen roller holding mechanism.

19. A printer as set forth in claim 17, wherein at least a portion of each protrusion piece of the pair of protrusion pieces is arc-shaped.

20. A printer as set forth in claim 17, wherein at least a portion of each holder of the pair of holders is arc-shaped.

21. A printer as set forth in claim 17, wherein the pair of holders is configured to close the insertion openings such that the shaft is retained by the cover.

22. A printer as set forth in claim 17, wherein the pair of protrusion pieces protrude at an end of the cover and another end of the cover is rotatably attached to the printer body.

23. A printer as set forth in claim 17, further comprising:

a platen roller holding mechanism, wherein the pair of holders is part of the platen roller holding mechanism.

24. A printer as set forth in claim 23, wherein the platen roller holding mechanism comprises an arc-shaped portion shaped to accommodate the rolled-shape printing medium.

25. A printer as set forth in claim 23, wherein the platen roller is releasably held to the cover by the holders.

26. A printer as set forth in claim 23, wherein the platen roller holding mechanism is a body that includes the holders, and is detachably attached to the cover, the platen roller holding mechanism configured to hold the platen roller to the cover when the platen roller holding mechanism is attached to the cover, and configured to release the platen roller from the cover when the platen roller holding mechanism is detached from the cover.

27. A printer as set forth in claim 23, wherein the printer body includes a first medium guide and the platen roller holding mechanism includes a second medium guide, the first medium guide and the second medium guide facing each other when the cover is closed.

28. A printer as set forth in claim 23, wherein the printer body includes a first medium guide and the platen roller holding mechanism includes a second medium guide, the first medium guide and the second medium guide forming parallel surfaces when the cover is closed.

29. A printer as set forth in claim 23, wherein the platen roller holding mechanism is attached to an inner surface of the cover.

30. A printer as set forth in claim 23, wherein the platen roller holding mechanism is attached to an inner surface of the cover by at least one screw.

31. A printer as set forth in claim 23, wherein the platen roller holding mechanism is detachable from the cover.

32. A printer as set forth in claim 17, wherein the pair of holders are detachable from the pair of protrusion pieces.

* * * * *